US009690239B2

(12) United States Patent
Ui et al.

(10) Patent No.: US 9,690,239 B2
(45) Date of Patent: Jun. 27, 2017

(54) IMAGE FORMING APPARATUS FOR FORMING AN IMAGE ON A CONTINUOUS SHEET WHILE REDUCING DAMAGE TO A ROTATING MEMBER

(71) Applicant: Konica Minolta, Inc., Chiyoda-ku, Tokyo (JP)

(72) Inventors: Makoto Ui, Hachioji (JP); Kazunori Katada, Hino (JP); Toshiaki Tomino, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/076,773

(22) Filed: Mar. 22, 2016

(65) Prior Publication Data

US 2016/0282775 A1 Sep. 29, 2016

(30) Foreign Application Priority Data

Mar. 25, 2015 (JP) ..... 2015-061984

(51) Int. Cl.
*G03G 15/20* (2006.01)
*G03G 15/00* (2006.01)
(Continued)

(52) U.S. Cl.
CPC ..... *G03G 15/2028* (2013.01); *B65H 20/02* (2013.01); *B65H 43/00* (2013.01);
(Continued)

(58) Field of Classification Search
CPC ..... G03G 15/2028; G03G 15/2032; G03G 15/6517
(Continued)

(56) References Cited

U.S. PATENT DOCUMENTS 4,265,198 A 5/1981 Shinohara et al.
5,432,593 A * 7/1995 Nishikawa et al.
..... G03G 15/2064 399/384

(Continued)

FOREIGN PATENT DOCUMENTS

JP 54-038133 A 3/1979
JP 2008-233770 A 10/2008
JP 2015-055859 A 3/2015

OTHER PUBLICATIONS

Extended European Search Report dated Aug. 12, 2016, issued by the European Patent Office in corresponding European Application No. 16158870.2. (7 pages).

(Continued)

*Primary Examiner* — William J Royer
(74) *Attorney, Agent, or Firm* — Buchanan Ingersoll & Rooney PC

(57) ABSTRACT

An image forming apparatus includes the following. A conveying unit conveys a continuous sheet at least longer than a length of the apparatus itself. A first rotating member can be pressed to and separated from a second rotating member. The first rotating member can be rotated separated from the second rotating member. The continuous sheet can be stopped and held when the first rotating member is separated from the second rotating member. The image forming apparatus further includes a control unit. When the continuous sheet is stopped and held and the rotation of the first rotating member is started separated from the second rotating member, the control unit moves at least one of the first rotating member and the continuous sheet so that the continuous sheet is not in contact with the first rotating member, and then the control unit starts rotation of the first rotating member.

17 Claims, 10 Drawing Sheets

(51) Int. Cl.
*B65H 20/02* (2006.01)
*B65H 43/00* (2006.01)

(52) U.S. Cl.
CPC ..... *G03G 15/2032* (2013.01); *G03G 15/6517* (2013.01); *B65H 2701/1842* (2013.01); *B65H 2801/03* (2013.01)

(58) Field of Classification Search
USPC ..... 399/68, 69, 122, 384
See application file for complete search history.

(56) References Cited

U.S. PATENT DOCUMENTS 5,532,811 A * 7/1996 Nishikawa et al. ..... G03G 15/6526 399/384
2016/0202648 A1* 7/2016 Takada ..... G03G 15/2032 399/69

OTHER PUBLICATIONS

Office Action issued by the Japanese Patent Office in corresponding Japanese Patent Application No. 2015-061984 on Jan. 24, 2017 (10 pages including partial English translation).

* cited by examiner

| | | |
|---|---|---|
| DEFORMING AMOUNT | SMALL | OPERATION A |
| | MEDIUM | OPERATION B |
| | LARGE | OPERATION C |

| | |
|---|---|
| NORMAL SHEET | OPERATION B |
| COATED SHEET | OPERATION C |
| FILM | OPERATION C |

| | | CONTINUOUS SHEET TYPE | | |
|---|---|---|---|---|
| | | NORMAL SHEET | COATED SHEET | FILM |
| DEFORMING AMOUNT | SMALL | OPERATION A | OPERATION A | OPERATION A |
| | MEDIUM | OPERATION B | OPERATION B | OPERATION C |
| | LARGE | OPERATION B | OPERATION C | OPERATION C |

IMAGE FORMING APPARATUS FOR FORMING AN IMAGE ON A CONTINUOUS SHEET WHILE REDUCING DAMAGE TO A ROTATING MEMBER

BACKGROUND OF THE INVENTION

Field of the Invention

The present invention relates to an image forming apparatus which forms an image on a continuous sheet, and specifically relates to reduction of damage to a rotating member.

Description of Related Art

In an electro-photographic image forming apparatus, a laser beam is irradiated uniformly on a charged photoreceptor drum based on image information to form an electrostatic latent image on the surface of the photoreceptor drum. Toner is supplied to the photoreceptor drum on which the electrostatic latent image is formed, the electrostatic latent image is made visible and the toner image is formed. After the toner image is transferred on a sheet with a nipping portion formed between an intermediate transfer belt and a secondary transfer roller, the toner image is fixed to the sheet by applying heat and pressure with the fixing unit, and the image is formed on the sheet.

The following method of fixing with a fixing unit is known. A heating roller including a heating source, an upper pressure roller and a lower pressure roller are provided. A fixing belt is suspended from the heating roller and the upper pressure roller. The heat generated from the heating source is transmitted to the sheet through the heating roller and the fixing belt to heat the sheet, and pressure is applied to the sheet by forming a nipping portion between the fixing belt and the lower pressure roller by applying pressure with the upper pressure roller. The heat generated from the heating source is first transmitted to the fixing belt, and then transmitted to the lower pressure roller through the fixing belt. The sheet is heated with the heat of the fixing belt and the heat of the lower pressure roller. The fixing method using such fixing belt is advantageous in that the time necessary to raise the temperature to the temperature suitable for fixing (raising the temperature of the fixing member to a temperature so that the toner image can be fixed to the sheet) and the power consumed to raise the temperature to the temperature suitable for fixing is low compared to a fixing method which does not use a fixing belt (method in which the heating roller comes into contact with the sheet to heat and apply pressure to the sheet).

Continuous sheets, such as a rolled sheet or a folded continuous sheet, in which the sheet is longer than the length of the apparatus itself (in other words, longer than the sheet passing path provided from the sheet feeding unit to the sheet ejecting unit of the apparatus itself) may be used in an image forming apparatus. When the user inputs an instruction to stop image forming during the image forming, or the image forming stops due to error processing for some reason, the image forming is stopped after ejecting the sheet from the ejecting unit or conveying of the sheet is stopped upstream from the fixing unit in the sheet passing path in an image forming apparatus which uses a non-continuous sheet (for example, sheet with A4 size). However, such process is not possible in the image forming apparatus using the continuous sheet. Therefore, the conveying of the continuous sheet stops with the continuous sheet remaining in the fixing unit. If the continuous sheet is removed from the apparatus itself when the image forming is stopped, the continuous sheet does not remain in the fixing unit. However, it is troublesome to remove the continuous sheet from the apparatus main body and to insert the sheet again.

When the image forming is stopped as described above, and the continuous sheet is left held in the nipping portion formed by the fixing belt and the lower pressure roller, although the power is not supplied to the heating source and the temperature of the fixing unit is lowered when the image forming is stopped, the continuous sheet is damaged by the heat of the fixing unit, for example, the shape or the color changing. Therefore, when the conveying of the continuous sheet is stopped in a fixing method using heat such as a fixing belt, there is a method of separating the fixing belt from the lower pressure roller to release the nip to avoid contact of the continuous sheet to the fixing belt so that the continuous sheet does not come into contact with the fixing belt and the heat is not directly transmitted to the continuous sheet. Since the continuous sheet does not come into contact with the fixing belt, the heat of the fixing unit is not directly transmitted to the continuous sheet. However, since the heat is transmitted to the continuous sheet through the air around the fixing belt in the fixing unit, deforming, etc. of the continuous sheet occurs although the amount of deforming is small compared to when the continuous sheet is in contact with the fixing belt.

When the image forming is started again, since the supply of power to the heating source is stopped and the heat of the fixing unit becomes lower, the temperature is raised to the temperature suitable for fixing as preparation for image forming. In raising the temperature to the temperature suitable for image forming, when heat is provided by the heating source of the heating roller, the fixing belt is rotated in a state with the fixing belt separated in order to maintain the temperature of the entire fixing belt uniform. In this case, the continuous sheet may come into contact with the fixing belt even when the fixing belt is separated due to the deformed continuous sheet. If the fixing belt is rotated while the continuous sheet is in contact with the fixing belt, there may be problems such as scratches occurring in the circumferential direction of the fixing belt due to friction between the continuous sheet and the fixing belt.

The scratches on the fixing belt in the circumferential direction become a cause for lines in a formed image. Images with lines are not beautiful. Such images are not desirable to maintain the quality of the image forming apparatus.

The above example describes using a fixing belt as an example of the rotating member, but a similar problem occurs when the heating roller is used as the rotating member. In other words, if the continuous sheet is deformed when the heating roller is rotated separated from the lower pressure roller, there may be problems such as scratches occurring in the circumferential direction of the heating roller due to friction between the continuous sheet and the heating roller.

The above problem also occurs when the intermediate transfer belt is used as the rotating member. In other words, if the continuous sheet is deformed when the intermediate transfer belt is rotated separated from the secondary transfer roller, there may be problems such as scratches occurring in the circumferential direction of the intermediate transfer belt due to friction between the continuous sheet and the intermediate transfer belt. Since the temperature near the intermediate transfer belt is lower than the fixing unit, the influence of the heat to the deforming of the continuous sheet is small, but the continuous sheet may be deformed by absorbing moisture.

Japanese Patent Application Laid-Open Publication No. 2008-233770 describes stopping the continuous sheet at a certain time interval when the printing of the continuous sheet is stopped so that sagging of the continuous sheet (the above-described deform includes sag) does not occur.

However, Japanese Patent Application Laid-Open Publication No. 2008-233770 conveys and stops the continuous sheet at a certain time interval, and therefore, continuous operation is necessary. Moreover, the continuous sheet is conveyed at a certain time interval as a white sheet without forming images. Therefore, this wastes a large amount of continuous sheets, and extra continuous sheets become necessary. This is disadvantageous in terms of cost. Since the conveying and stopping at a certain time interval is not done while the power of the apparatus is turned off, the continuous sheet is deformed by heat and moisture when the power of the apparatus is turned off. Therefore, there is a possibility that the continuous sheet comes into contact with the rotating member when the power of the apparatus is turned on. In this case, if the rotating member is rotated with the continuous sheet in contact with the rotating member, there may be problems such as the scratches occurring in the circumferential direction of the rotating member.

BRIEF SUMMARY OF THE INVENTION

The present invention has been made in consideration of the above problems, and one of the main objects is to provide an image forming apparatus including a pair of rotating members in which scratches to the rotating member due to the rotating member rotating in a separated state is prevented efficiently.

In order to achieve at least one of the above-described objects, according to an aspect of the present invention, there is provided an image forming apparatus including: a conveying unit which conveys a continuous sheet at least longer than a length of the apparatus itself; an image forming unit which forms an image on the continuous sheet conveyed by the conveying unit; a first rotating member; and a second rotating member which is provided on a side opposite of the first rotating member with respect to the conveying unit, wherein, the first rotating member can be pressed to and separated from the second rotating member; the first rotating member can be rotated separated from the second rotating member; the continuous sheet can be stopped and held when the first rotating member is separated from the second rotating member; and the image forming apparatus further comprises a control unit wherein, when the continuous sheet is stopped and held and the rotation of the first rotating member is started separated from the second rotating member, the control unit moves at least one of the first rotating member and the continuous sheet so that the continuous sheet is not in contact with the first rotating member, and then the control unit starts rotation of the first rotating member.

Here, as a combination of a first rotating member and a second rotating member, there are, for example, fixing belt and lower pressure roller, heating roller and lower pressure roller, and intermediate transfer belt and secondary transfer roller.

BRIEF DESCRIPTION OF THE DRAWINGS

The present invention will become more fully understood from the detailed description given hereinbelow and the appended drawings, and thus are not intended to define the limits of the present invention, and wherein.

DETAILED DESCRIPTION OF PREFERRED EMBODIMENTS

An embodiment of the present invention is described in detail with reference to the drawings.

Figure 1:
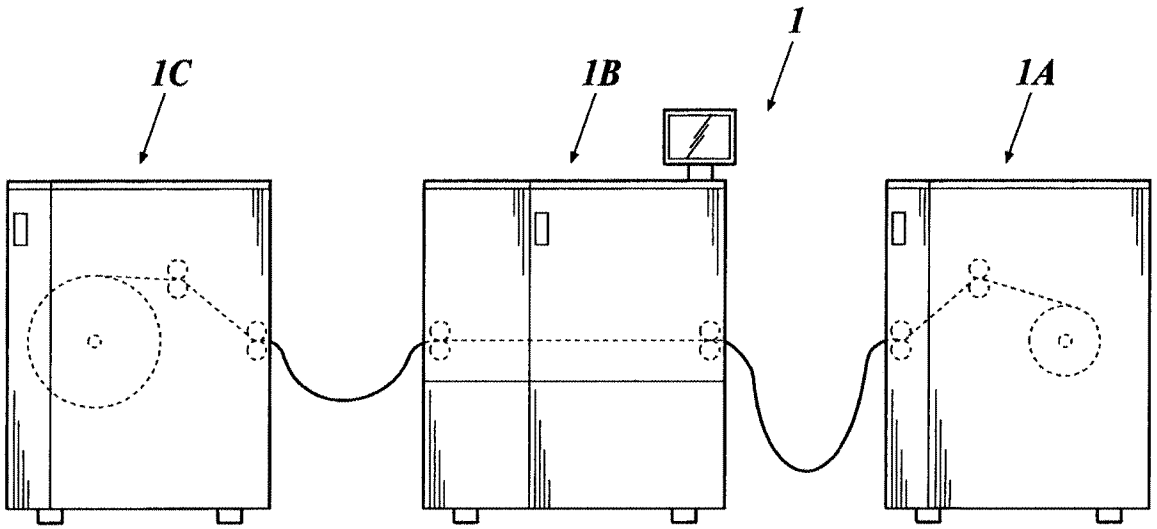
FIG. 1 is a diagram showing an image forming apparatus according to an embodiment of the present invention.

FIG. 1 is a diagram showing an image forming apparatus 1 according to an embodiment of the present invention. The image forming apparatus 1 includes a sheet feeding apparatus 1A, an apparatus main body 1B, and a winding apparatus 1C. The image forming apparatus 1 may include only the apparatus main body 1B and not have the sheet feeding apparatus 1A and the winding apparatus 1C.

The sheet feeding apparatus 1A stores a continuous sheet such as a rolled sheet or a folded continuous sheet and feeds the continuous sheet to the apparatus main body 1B. The apparatus main body 1B forms an image on a continuous sheet fed from the sheet feeding apparatus 1A. The winding apparatus 1C winds the continuous sheet sent by the apparatus main body 1B according to an instruction from the apparatus main body 1B.

Figure 2:
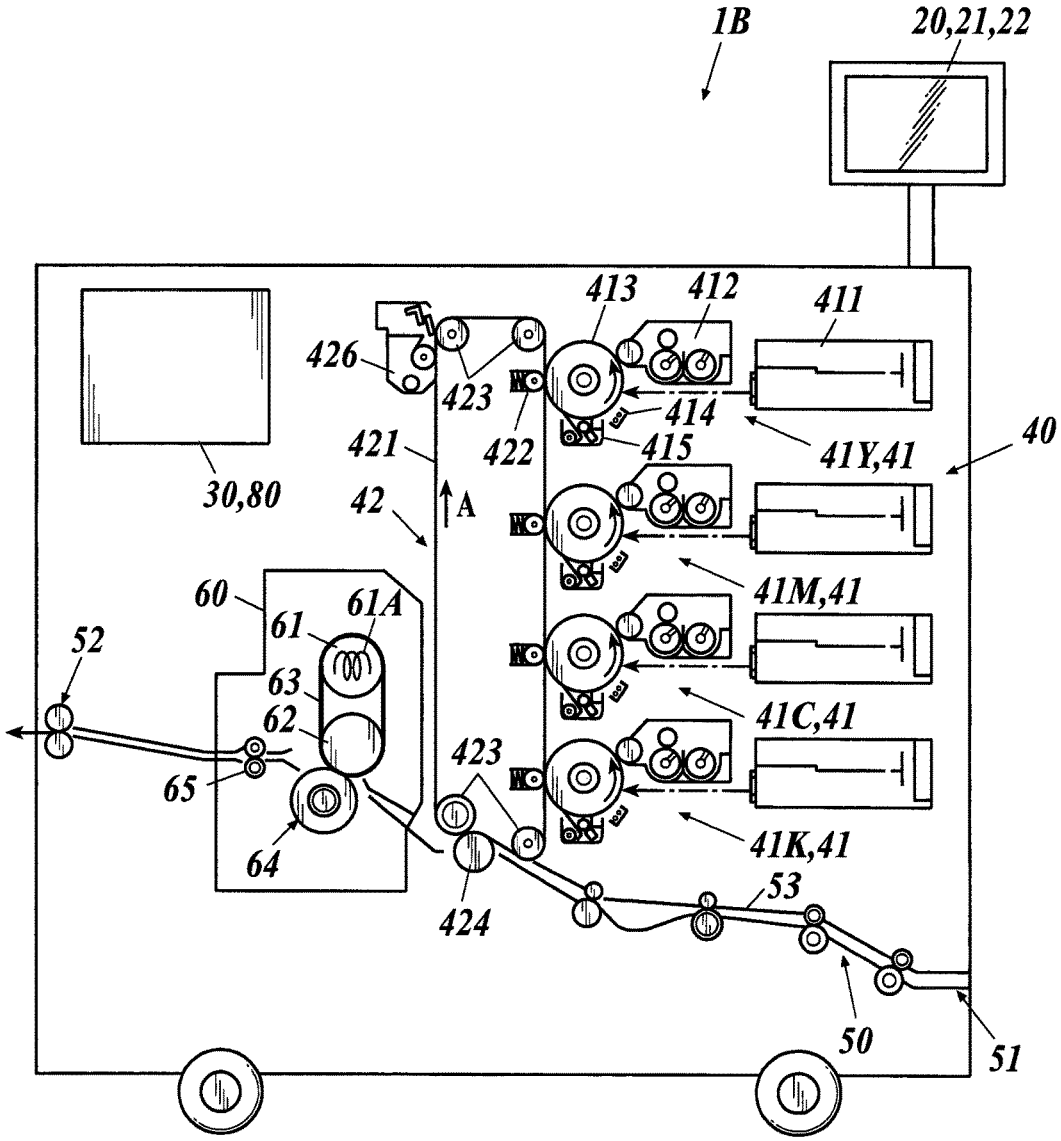
FIG. 2 is a diagram showing a configuration of an apparatus main body.
Figure 3:
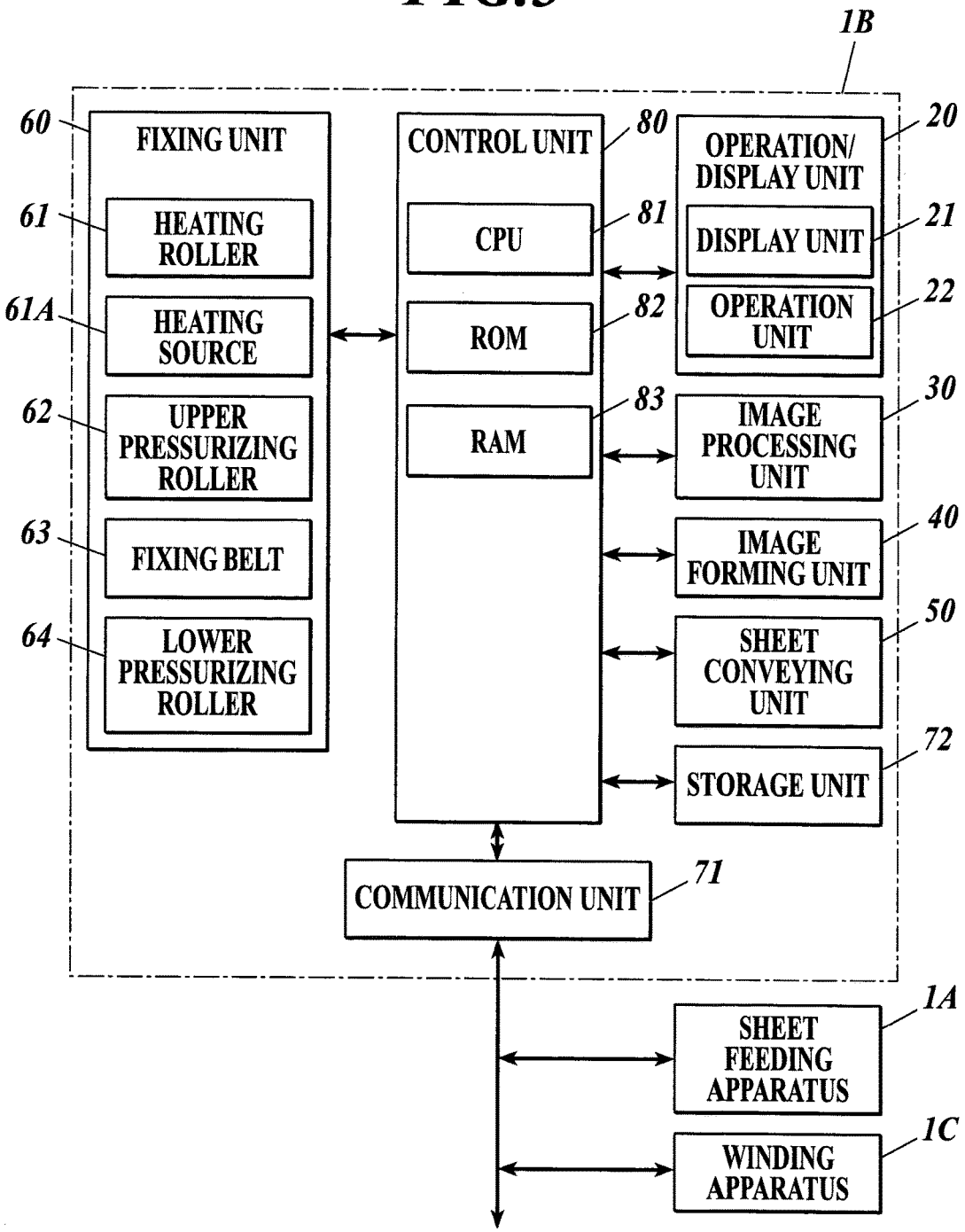
FIG. 3 is a block diagram to describe control of the image forming apparatus.

FIG. 2 is a diagram showing an example of a configuration of the apparatus main body 1B. FIG. 3 is a block diagram showing a main portion of a control system of the apparatus main body 1B.

The apparatus main body 1B shown in FIG. 2 and FIG. 3 is an intermediate transfer type color image forming apparatus using the technique of an electro-photographic process. In the apparatus main body 1B, a vertical tandem method is employed. Photoreceptor drums 413 corresponding to the four colors of Y (yellow), M (magenta), C (cyan), and K (black) are positioned in series in a running direction (perpendicular direction) of an intermediate transfer belt 421. A toner image of each color is sequentially transferred to the intermediate transfer belt 421. In other words, the apparatus main body 1B performs primary transfer of the toner image of each color of YMCK formed on the photoreceptor drums 413 onto the intermediate transfer belt 421, and overlaps the toner images of four colors on the intermediate transfer belt 421. Then, secondary transfer is performed on the continuous sheet to form the image.

As shown in FIG. 2 and FIG. 3, the apparatus main body 1B includes an operation/display unit 20, an image processing unit 30, an image forming unit 40, a sheet conveying unit 50, a fixing unit 60, and a control unit 80.

The control unit 80 includes a CPU 81, a ROM 82, a RAM 83, and the like. The CPU 81 reads a program according to a processing content from the ROM 82 or a storage unit 72, and develops the program in the RAM 83. In coordination with the developed program, the CPU 81 controls the operation of the sheet feeding apparatus 1A, the apparatus main body 1B, and the winding apparatus 1C.

A communication unit 71 includes various interfaces such as a network card, a modem, a USB, and the like. The storage unit 72 includes a nonvolatile semiconductor memory (a flash memory), and a hard disk drive. For example, the storage unit 72 stores a look-up table referred to when the operation of each block is controlled.

The control unit 80 transmits and receives various pieces of data between external devices (for example, a personal computer) connected to a communication network such as a LAN, a WAN, etc. through the communication unit 71. For example, the control unit 80 receives image data (input image data) in a page description language (PDL) transmitted from an external apparatus and forms the image on the continuous sheet based on the above. The control unit 80 transmits and receives various pieces of data between the sheet feeding apparatus 1A and the winding apparatus 1C through the communication unit 71.

The operation/display unit 20 includes a liquid crystal display (LCD) with a touch panel and functions as a display unit 21 and an operation unit 22.

The display unit 21 displays various operation screens and operation statuses of various functions according to a display control signal input from the control unit 80. The display unit 21 receives touch operation by the user and outputs the operation signal to the control unit 80.

The operation unit 22 includes various operation keys such as numeric keys, a start key, etc. The operation unit 22 receives operation of various input by the user and outputs the operation signal to the control unit 80. The user may operate the operation/display unit 20 and instruct setting such as quality setting and image forming setting such as magnification setting, application setting, output setting, sheet setting, etc. The user can also operate the operation/display unit 20 to instruct conveying of the sheet.

The image processing unit 30 includes a circuit which performs digital image processing according to the initial setting or user setting on the input image data. For example, the image processing unit 30 performs gradation correction based on gradation correction data (gradation correction table) under control of the control unit 80. The image processing unit 30 performs various correction processing such as color correction, shading correction, etc. and compression processing on the input image data. The image forming unit 40 is controlled based on the image data on which such processing is performed.

The image forming unit 40 includes image forming units 41 for forming an image with color toners including Y-component, M-component, C-component, and K-component, based on the input image data, an intermediate transfer unit 42 and the like.

The image forming unit 41 includes 4 image forming units 41Y, 41M, 41C, and 41K for the Y-component, M-component, C-component, and K-component, respectively. The image forming units 41Y, 41M, 41C, and 41K have similar configurations, therefore, the same components are shown with the same reference numerals. The image forming unit 41 includes an exposure apparatus 411, a developing apparatus 412, a photoreceptor drum 413, a charging apparatus 414, a drum cleaning apparatus 415, and the like.

The photoreceptor drum 413 is a negative charge type organic photoreceptor (OPC) on which an undercoat layer (UCL), a charge generating layer (CGL), and a charge transporting layer (CTL) are sequentially layered on a circumferential surface of an aluminum conducting cylinder (aluminum tube). The charge generating layer includes an organic semiconductor in which the charge generating material (for example, phthalocyanine pigment) is dispersed in a resin binder (for example, polycarbonate). The charge generating layer receives exposure of light from the exposure apparatus 411 and generates a pair of positive and negative charge. The charge transporting layer includes material in which a positive hole transporting material (electron donating nitrogen compound) is dispersed in a resin binder, and transports the positive charge generated in the charge generating layer to the surface of the charge transporting layer.

The charging apparatus 414 includes a corona discharger such as a scorotron charging apparatus or corotron charging apparatus. The charging apparatus 414 negatively charges the entire surface of the photoreceptor drum 413 with corona discharge.

For example, the exposure apparatus 411 includes a LED print head including an LED array in which a plurality of light emitting diodes (LED) are arranged in a straight line, an LPH driving unit (driver IC) to drive each LED, and a lens array to image emitted light from the LED array on the photoreceptor drum 413. One LED of the LED array corresponds to one dot of the image. The control unit 80 controls the LPH driving unit so that predetermined driving electric current flows in the LED array and specific LED emit light.

The exposure apparatus 411 emits light corresponding to the image of each color component on the photoreceptor drum 413. The surface charge (negative charge) of the photoreceptor drum 413 is neutralized by transporting the positive charge generated in the charge generating layer of the photoreceptor drum 413 to the surface of the charge transporting layer. With this, the electrostatic latent image for each color component is formed on the surface of the photoreceptor drum 413 by the difference in potential from the surroundings.

The developing apparatus 412 stores developers for various color components (double component developer including components such as toner and a magnetic carrier). The developing apparatus 412 visualizes the electrostatic latent image by attaching toner of various color components on the surface of the photoreceptor drum 413 to form the toner image. Specifically, developing bias voltage is applied to the developer carrier (developing roller), and the charged toner on the developer carrier moves and is attached to the exposed portion on the surface of the photoreceptor drum 413 by the potential difference between the photoreceptor drum 413 and the developer carrier.

The drum cleaning apparatus 415 includes a drum cleaning blade which slides against the surface of the photoreceptor drum 413, and removes the residual transferred toner remaining on the surface of the photoreceptor drum 413 after primary transfer.

The intermediate transfer unit 42 includes an intermediate transfer belt 421, a primary transfer roller 422, a plurality of supporting rollers 423, a secondary transfer roller 424, a belt cleaning apparatus 426, and the like.

The intermediate transfer belt 421 includes an endless belt, and is suspended in a loop shape on a plurality of supporting rollers 423. At least one of the plurality of supporting rollers 423 is a driving roller, and the others are following rollers. For example, it is preferable that the supporting roller 423 positioned to the downstream side of the belt running direction than the K-component primary transfer roller 422 is the driving roller. The rotation of the driving roller causes the intermediate transfer belt 421 to run at a certain speed in an arrow A direction.

The primary transfer roller 422 is positioned on the inner circumferential face side of the intermediate transfer belt 421 facing the photoreceptor drums 413 for each color component. The primary transfer roller 422 is pressed against the photoreceptor drum 413 with the intermediate transfer belt 421 in between, and a primary transfer nip is formed to transfer the toner image from the photoreceptor drum 413 to the intermediate transfer belt 421.

The secondary transfer roller 424 is positioned on the outer circumferential face side of the intermediate transfer belt 421 facing one of the plurality of supporting rollers 423. The supporting roller 423 positioned facing the intermediate transfer belt 421 is called the backup roller. The secondary transfer roller 424 is pressed against the backup roller with the intermediate transfer belt 421 in between, and a secondary transfer nip is formed to transfer the toner image from the intermediate transfer belt 421 to the continuous sheet.

When the intermediate transfer belt 421 passes the primary transfer nip, the toner image on each photoreceptor drum 413 is sequentially overlapped on the intermediate transfer belt 421 and primary transfer is performed. Specifically, the primary transfer bias is applied to the primary transfer roller 422, and charge with a polarity opposite of the toner is provided on the back face side of the intermediate transfer belt 421 (side in contact with the primary transfer roller 422). With this, the toner image is electrostatically transferred on the intermediate transfer belt 421.

Then, when the continuous sheet passes the secondary transfer nip, secondary transfer is performed and the toner image on the intermediate transfer belt 421 is transferred on the continuous sheet. Specifically, the secondary transfer bias is applied to the secondary transfer roller 424, and a charge with a polarity opposite to the toner is provided to the rear face side of the continuous sheet (side in contact with the secondary transfer roller 424), and the toner image is electrostatically transferred to the continuous sheet. The continuous sheet on which the toner image is transferred is conveyed to the fixing unit 60.

The belt cleaning apparatus 426 includes a belt cleaning blade which slides against the surface of the intermediate transfer belt 421. The belt cleaning apparatus 426 removes the residual toner remaining on the surface of the intermediate transfer belt 421 after secondary transfer.

In the intermediate transfer unit 42, instead of the secondary transfer roller 424, a configuration in which a secondary transfer belt is suspended in a loop shape on a plurality of supporting rollers including the secondary transfer roller can be employed (belt type secondary transfer unit).

The sheet conveying unit 50 includes a sheet feeding unit 51, a sheet ejecting unit 52, a sheet passing path 53, and the like. The sheet feeding unit 51 guides the continuous sheet conveyed from the sheet feeding apparatus 1A to the sheet passing path 53. The sheet passing path 53 is provided with a plurality of conveying rollers including the intermediate conveying roller, etc. The sheet passing path 53 conveys the continuous sheet fed from the sheet feeding unit 51 to the image forming unit 40 (second transfer unit), fixing unit 60, and sheet ejecting unit 52 in this order. The sheet ejecting unit 52 guides the continuous sheet conveyed from the sheet passing path 53 to the winding apparatus 1C.

The fixing unit 60 includes a heating roller 61, a heating source 61A which heats a heating roller 61, an upper pressure roller 62, an endless fixing belt 63 suspended between the heating roller 61 and the upper pressure roller 62, a lower pressure roller 64, and the like.

The heating source 61A is positioned inside or near the heating roller 61. The control unit 80 controls the output of the heating source 61A and heats the heating roller 61. The fixing belt 63 is rotated so that the heat of the heating roller 61 is transmitted to the entire fixing belt 63. The operation of heating to the temperature suitable for fixing is performed with the fixing belt 63 separated from the lower pressure roller 64.

In the fixing unit 60, the fixing belt 63 suspended between the heating roller 61 and the upper pressure roller 62 can be pressed to or separated from the lower pressure roller 64. The heating roller 61 and the upper pressure roller 62 are supported movably by a supporting body (not shown) and an eccentric cam (not shown) is in contact with the supporting body. The eccentric cam rotates with the fulcrum as the center, and the supporting body moves in the perpendicular direction (pressing/separating direction) by the rotation of the eccentric cam. The heating roller 61 and the upper pressure roller 62 move with the movement of the holding body, and with this, the fixing belt 63 can be pressed to or separated from the lower pressure roller 64. The eccentric cam moves by the driving of the driving unit (motor or gear, not shown). The driving unit is driven by the instruction from the control unit 80.

When the fixing belt 63 is pressed to the lower pressure roller 64, the nipping portion is formed to hold and convey the continuous sheet. The continuous sheet is heated and pressurized when passing the nipping portion and the toner image is fixed.

Figure 4:
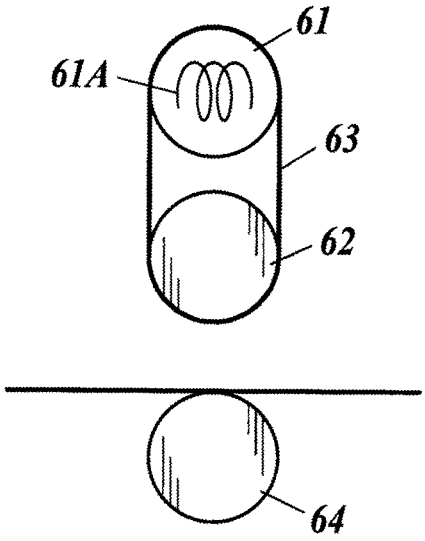
FIG. 4 is a diagram showing a state in which a fixing belt is separated from a lower pressure roller.

FIG. 4 is a diagram showing a state directly after the fixing belt 63 separates from the lower pressure roller 64. When the image forming on the continuous sheet stops, first, after the image forming stops, the supply of power to the heating source 61A stops. Then, when the formed image is conveyed to a downstream side than the fixing unit 60, the conveying of the continuous sheet stops and the fixing belt 63 is separated from the lower pressure roller 64. Here, directly after the conveying of the continuous sheet stops, the continuous sheet is not deformed as in FIG. 4.

Figure 5:
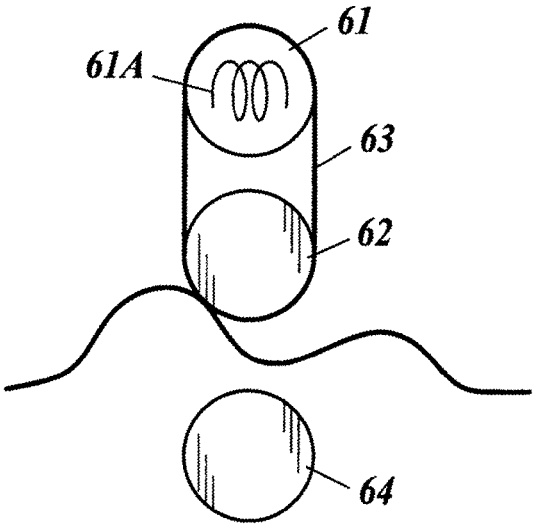
FIG. 5 is a diagram showing when the continuous sheet is deformed.

FIG. 5 is a diagram showing deforming occurring in the continuous sheet in the fixing unit 60. If the continuous sheet stalled in the fixing unit 60 (specifically, between the fixing belt 63 and the lower pressure roller 64) after conveying stops, although the supply of power to the heating source 61A stops and the temperature of the fixing unit 60 is lowered, the heat remaining in the fixing unit 60 causes the continuous sheet to be deformed. Due to such deform in the continuous sheet, the continuous sheet may come into contact with the fixing belt 63 even if the fixing belt 63 is separated from the lower pressure roller 64 (for example, as shown in FIG. 5, deforming in a wave in the perpendicular direction). In this state, if the fixing belt 63 is rotated to raise the temperature of the fixing unit 60 in which the temperature fell to the temperature suitable for fixing as preparation to start image forming again, scratches are formed in the circumferential direction of the fixing belt 63 by the continuous sheet in contact with the fixing belt 63.

Therefore, according to the embodiment of the present invention, before the rotating of the fixing belt 63 starts, the continuous sheet is placed in a state not in contact with the fixing belt 63, and then the rotating of the fixing belt 63 starts. When the fixing belt 63 is in a separated state, and the fixing belt 63 is rotated in a state that the conveying of the continuous sheet is stopped, the processing above is performed before the fixing belt 63 is rotated.

Figure 6:
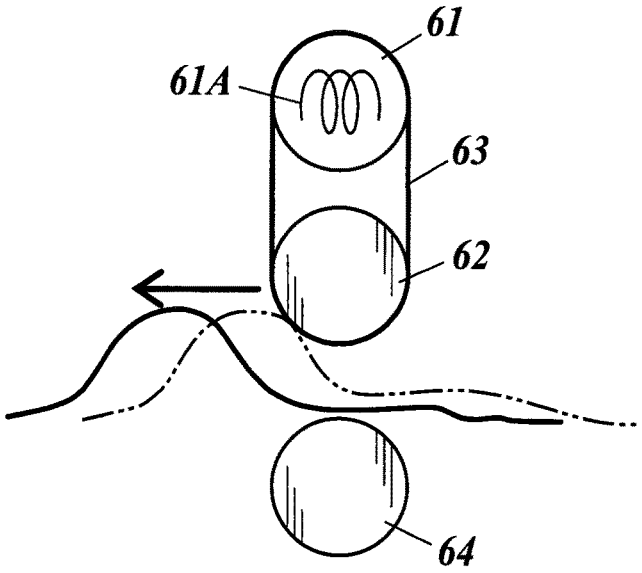
FIG. 6 is a diagram to describe moving the continuous sheet so as not to come into contact with the fixing belt.

FIG. 6 is a diagram describing moving the continuous sheet as an example of the continuous sheet not in contact with the fixing belt 63. In FIG. 6, the dotted line shows the position of the continuous sheet before the continuous sheet is moved, and the arrow shows the direction that the continuous sheet is moved. When the rotating of the fixing belt 63 is started, the continuous sheet is moved from the fixing belt 63 as shown in FIG. 6, and then the fixing belt 63 is rotated. According to the above, since the continuous sheet is not in contact with the fixing belt 63 when the rotating of the fixing belt 63 starts, it is possible to prevent scratches in the fixing belt 63 caused by rotation. With this, the decrease of quality in the image forming can be prevented in the image forming apparatus 1. The direction that the continuous sheet is moved is not limited to the direction of the arrow, and it is enough if the continuous sheet is moved to a state not in contact with the fixing belt 63.

As the means to move the continuous sheet, a new component can be provided to prevent contact (adjust or press sag, or change the shape or position of the sheet passing path 53). For example, a movable bar can be provided near the fixing belt 63 and sag can be adjusted by moving the bar in the conveying direction or sag can be pressed by moving the bar in the perpendicular direction. When only the member used for conveying the continuous sheet is used (conveying roller, etc.), the space and the cost can be reduced, and therefore, this is preferable.

Figure 7:
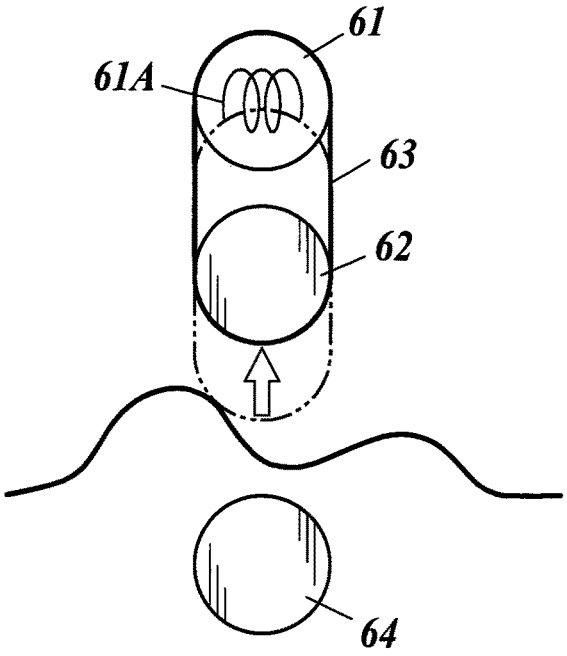
FIG. 7 is a diagram to describe moving the fixing belt so as not to come into contact with the continuous sheet.

FIG. 7 is a diagram describing moving the fixing belt 63 as an example to move the continuous sheet in a state not in contact with the fixing belt 63. In FIG. 7, the dotted line shows the position of the fixing belt 63 before moving the fixing belt 63, and the arrow shows the direction the fixing belt 63 is moved to. The control unit 80 moves the heating roller 61 and the upper pressure roller 62 with the driving unit (not shown) to move the fixing belt 63. The fixing belt 63 is to be moved so that the fixing belt 63 is separated from the continuous sheet and the direction that the fixing belt 63 is moved does not always have to be the direction of the arrow of FIG. 7. When the fixing belt 63 is moved in the pressing and separating direction (perpendicular direction) to form the nip, the movement can be done with a simple configuration compared to moving in other directions, and extra space to move in other directions is not necessary. Specifically, preferably, the fixing belt 63 is moved down in the perpendicular direction from the position of when the movement of the fixing belt 63 starts. When the fixing belt 63 is moved and the fixing belt 63 is returned to the position from where moving started when rotating starts, this is effective because no influence is applied to the operation after start of rotating.

Another example to make the continuous sheet in a state not in contact with the fixing belt 63 is to combine the movement of the fixing belt 63 and the above-described movement of the continuous sheet so that the continuous sheet does not come into contact with the fixing belt 63.

Figure 8A:
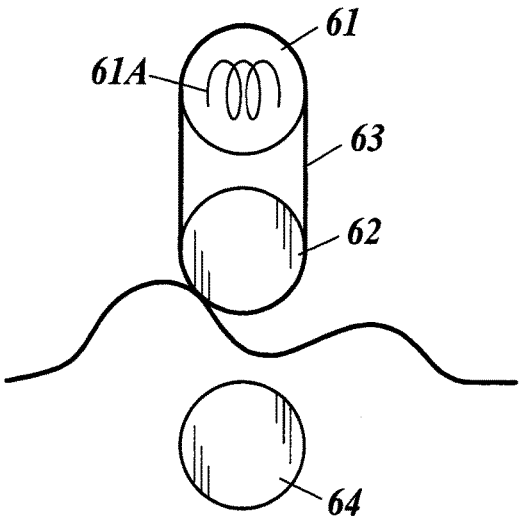
FIG. 8A and FIG. 8B are diagrams showing the continuous sheet pressed against and in contact with the fixing belt.
Figure 8B:
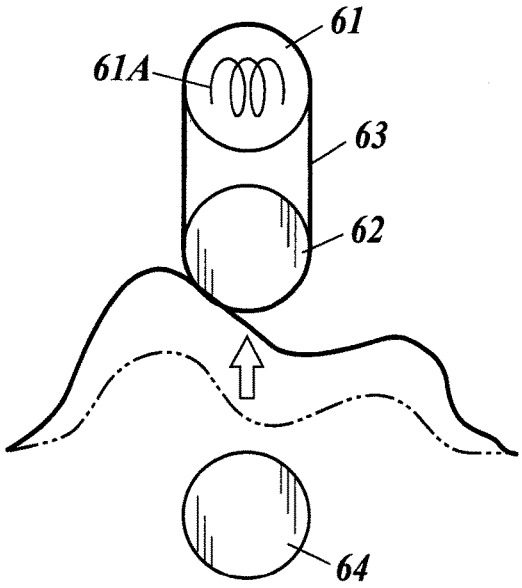

FIG. 8A and FIG. 8B are diagrams describing a problem which may occur when the degree of deform of the continuous sheet is large and the continuous sheet is pressed against and is in contact with the fixing belt 63. FIG. 8A shows a state in which deforming of the continuous sheet occurred in the fixing unit 60 (diagram similar to FIG. 5). Here, if only the fixing belt 63 is moved, as shown in FIG. 8B, the continuous sheet may also be moved with the movement of the fixing belt 63 and the contact with the fixing belt 63 may be maintained. The dotted line shows the position of the continuous sheet before the continuous sheet is moved. In order to overcome the above problem, preferably, at least the continuous sheet is moved.

Figure 9:
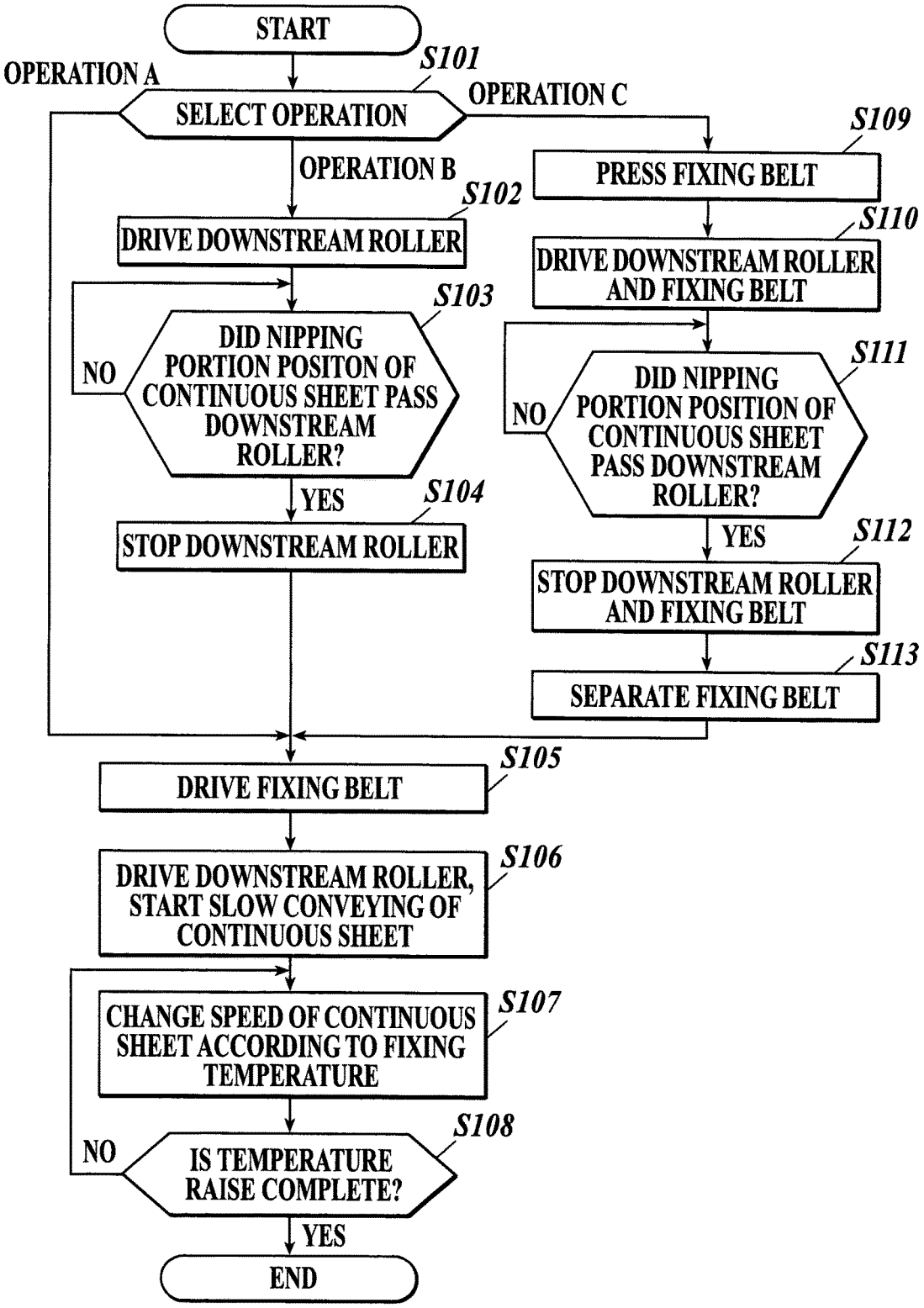
FIG. 9 is a flowchart showing a process of processing regarding moving the continuous sheet of the present invention.

FIG. 9 is a flowchart showing a process of processing to raise the temperature to a temperature suitable for fixing. In the processing to raise the temperature to the temperature suitable for fixing, processing to raise the temperature to the temperature suitable for fixing and to move the continuous sheet and the fixing belt 63 when the temperature is raised to the temperature suitable for fixing is performed. The processing to raise the temperature to the temperature suitable for fixing is started when there is a request to perform the processing.

In the selection of operation in step S101, the control unit 80 selects the operation regarding moving the continuous sheet. The selection unit is described below. In step S102 (when operation B is selected in step S102), the control unit 80 drives the downstream roller.

Figure 10A:
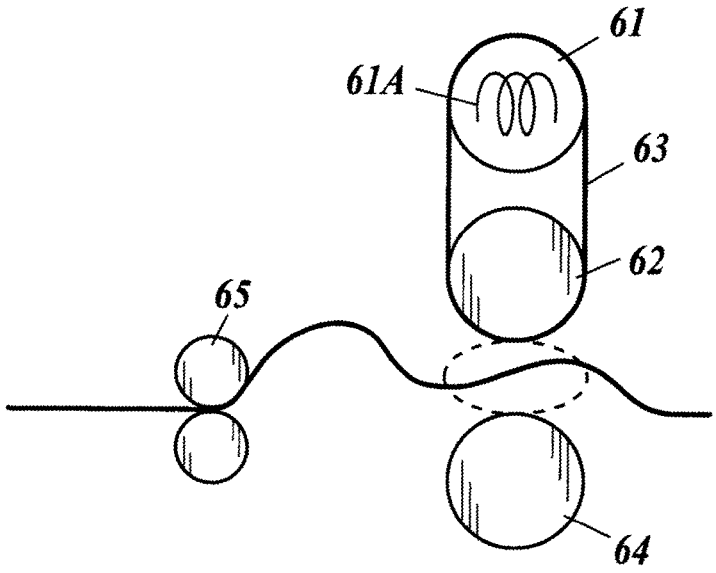
FIG. 10A and FIG. 10B are diagrams describing an operation of a downstream roller.
Figure 10B:
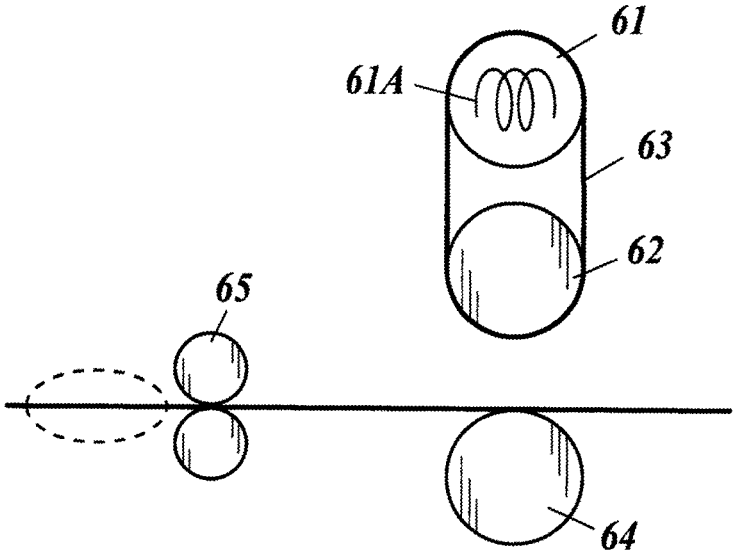

FIG. 10A and FIG. 10B are diagrams describing the operation of the downstream roller 65. The downstream roller 65 is a conveying roller provided to the downstream side than the fixing belt 63. The downstream roller 65 is driven and the continuous sheet is conveyed so that the continuous sheet is moved and the sag of the continuous sheet as shown in FIG. 10A does not come into contact with the fixing belt 63.

Here, the upstream roller (conveying roller on the upstream side than the fixing belt 63) can be driven. However, if the upstream roller is not driven and only the downstream roller 65 is driven, the continuous sheet can be pulled and the sag can be easily fixed by the continuous sheet moving. Moreover, if the continuous sheet moves and the sag also moves upstream, the sag remains in the apparatus and various arrangements become necessary.

In a state as shown in FIG. 10A, conveying of the continuous sheet is not enough (the example when it is enough is described below), and the sag remains in the upstream side than the downstream roller 65 (fixing belt 63 side). Therefore, the sag may move to the fixing belt 63 side and the continuous sheet may come into contact with the fixing belt 63 again.

Preferably, when the downstream roller 65 is driven, the continuous sheet in the nipping portion of the fixing belt 63 shown with a dotted line in FIG. 10A is conveyed past the downstream roller 65 (to the position shown with a dotted line in FIG. 10B) (step S103). With this, there is no sag to the fixing belt 63 side from the downstream roller 65 as shown in FIG. 10B, and it is possible to more reliably prevent contact.

After the downstream roller 65 moves the position of the nipping portion of the continuous sheet past the downstream roller 65 (step S103, YES), the control unit 80 stops the downstream roller 65 (step S104), and drives the heating source 61A and the fixing belt 63 to start raising the temperature to the temperature suitable for fixing (step S105).

Then, the control unit drives the downstream roller 65 according to the progress of raising the temperature, and the slow conveying of the continuous sheet is started (step S106). Here, slow means a slower speed than the image forming speed. The continuous sheet can be conveyed at a normal speed (image forming speed) but it is preferable to convey at a slow speed. Slow conveying can save waste of the continuous sheet compared to conveying at a normal speed.

When the conveying speed is too slow, the continuous sheet is deformed again by the heat caused by raising the temperature to the temperature suitable for fixing, and such deforming makes the continuous sheet come into contact with the fixing belt 63. Therefore, preferably, when the temperature is raised, the conveying speed is gradually raised according to the temperature of the fixing unit 60 (step S107). With this, it is possible to suppress waste of the continuous sheet and to suppress deform of the continuous sheet.

In the image forming apparatus (for example, Japanese Patent Application Laid-Open Publication No. 2008-233770), in which conveying of the continuous sheet is performed at a predetermined time interval when image forming is not performed, the continuous sheet continues to be wasted when the image forming is not performed. However, according to the present embodiment, the continuous sheet is conveyed only when the processing is performed so that the continuous sheet does not come into contact with the fixing belt 63 and when the processing is performed to raise the temperature to the temperature suitable for fixing. Therefore, it is possible to suppress waste of the continuous sheet.

The control unit 80 monitors the temperature of the fixing unit 60 after start of conveying the continuous sheet and determines whether the temperature is raised to the temperature suitable for fixing (step S108). When the raise of the temperature is not complete (step S108, NO), the speed of conveying the continuous sheet is changed according to the fixing temperature (step S107). When the raise of the temperature is complete (step S108, YES), the processing to raise the temperature to the temperature suitable for fixing ends.

Figure 11A:
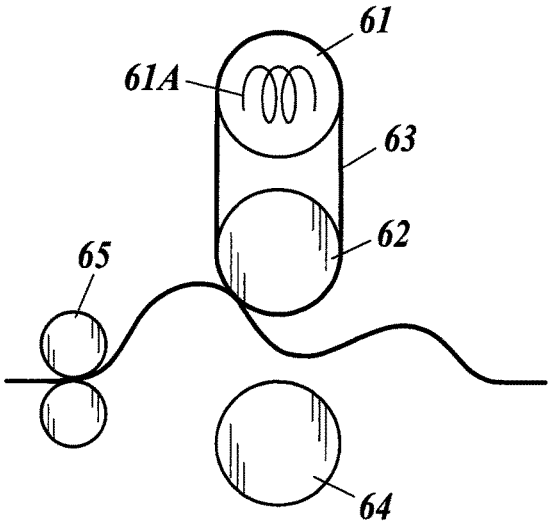
FIG. 11A to FIG. 11D are diagrams describing moving the continuous sheet after crimping the fixing belt.

Next, the example in which operation C is selected in step S101 is described. FIG. 11A to FIG. 11D are diagrams showing a state of the fixing belt 63 and the continuous sheet when the continuous sheet is moved after pressing to the fixing belt 63. FIG. 11A shows a state before the continuous sheet is moved (same as FIG. 5).

Figure 11B:
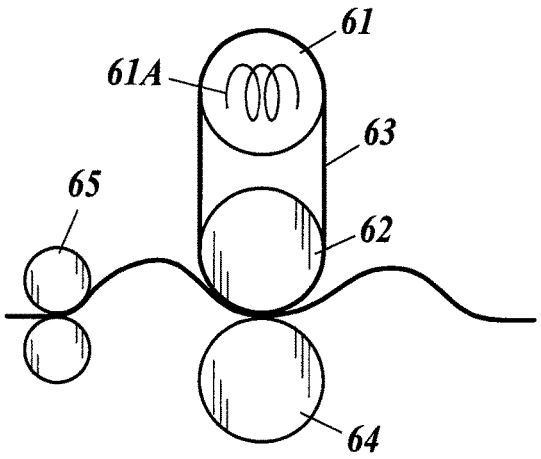

In the operation C, the control unit 80 first presses the fixing belt 63 (step S109). FIG. 11B shows this state. When the fixing belt 63 is simply pressed and is not rotated in the separated state, no scratches are made on the fixing belt 63 in the circumferential direction.

When the fixing belt 63 is pressed (after step S109), the control unit 80 drives the downstream roller 65 and the fixing belt 63 (step S110). Even if the downstream roller 65 and the fixing belt 63 are driven when the fixing belt 63 is pressed, the continuous sheet is moved (conveyed) with the rotation of the fixing belt 63. Therefore, the relative position with respect to the fixing belt 63 does not change, and the scratches are not made on the fixing belt 63 in the circumferential direction. Step S111 is similar to step S103.

Figure 11C:
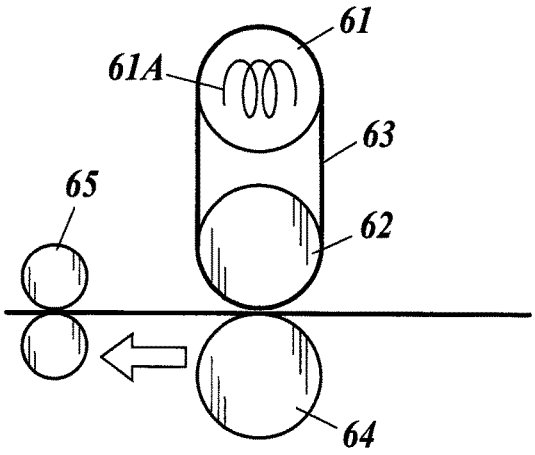

When the continuous sheet is moved so that the nipping portion position of the continuous sheet is past the downstream roller (step S111, YES), the downstream roller 65 and the fixing belt 63 are stopped (step S112). This state is shown in FIG. 11C (arrow shows conveying direction). When the continuous sheet is moved after pressing the fixing belt 63, the conveying power is enhanced compared to when the fixing belt 63 is not used in the conveying. Therefore, it is possible to more reliably move the continuous sheet, and the sag of the continuous sheet can be stretched.

Figure 11D:
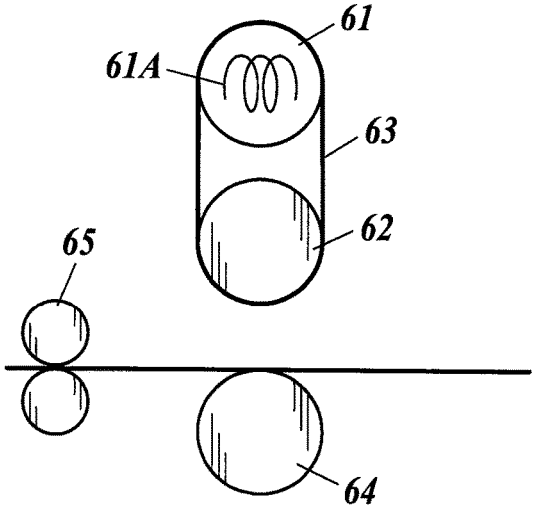

After the downstream roller 65 and the fixing belt 63 is stopped (after step S112), the control unit 80 separates the fixing belt 63 as shown in FIG. 11D (step S113). FIG. 11D is a diagram the same as FIG. 4, and the sag of the continuous sheet is solved by moving the continuous sheet. Therefore, the continuous sheet is not in contact with the fixing belt 63, and even if the fixing belt 63 is rotated, no scratches are made on the fixing belt 63. After step S113, the processing advances to step S105.

Next, the selection of operation in step S101 is described. In the operation selection, the control unit 80 selects the operation regarding the moving of the continuous sheet from the following 3 operations, operation A (do nothing), operation B (pull with downstream roller 65), and operation C (move after pressing fixing belt 63). The operation A corresponds to when the continuous sheet is not in contact with the fixing belt 63 (for example, when it is determined that the degree of deforming of the continuous sheet is small). The operations B and C correspond to when the continuous sheet comes into contact with the fixing belt 63. Among the above, operation C corresponds to when the possibility of contact is high (for example, when it is determined that the degree of deforming of the continuous sheet is large).

Comparing the operation B and the operation C, the conveying power of operation C is higher than operation B and the continuous sheet with the high degree of deforming can be stably conveyed. Since the operation C performs pressing and separating of the fixing belt 63, the processing takes more time than the operation B. Therefore, when the degree of deforming is smaller than the degree of deforming corresponding to the operation C, the operation B with the faster processing speed is more suitable.

Figures 12A, 12B, 12C, 13:
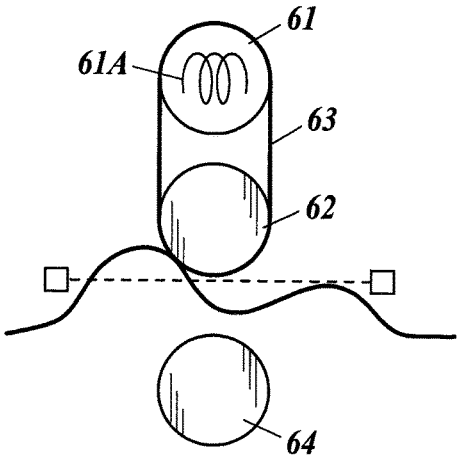
FIG. 12A to FIG. 12C are tables describing selection of operation to move the continuous sheet.
FIG. 13 is a diagram showing a deformation amount detection example of the continuous sheet.

FIG. 12A to FIG. 12C are tables describing the selection of operation. FIG. 12A is an example of operation switching according to the amount of deforming of the continuous sheet. When the amount of deforming is small, the possibility that the continuous sheet comes into contact with the fixing belt 63 is small, and the operation A is selected. When the amount of deforming is large, it is judged that a high power of conveying is necessary to convey the continuous sheet, and the operation C is selected. When the amount of deforming is middle, the operation B is selected. By switching the operation according to the amount of deforming of the continuous sheet, suitable processing can be performed regarding the movement of the continuous sheet.

FIG. 13 is an example in which a deforming amount detecting unit is provided to detect the amount of deforming of the continuous sheet. A photo-sensor is provided along the sheet passing path 53 so that the fixing belt 63 is between the light emitting unit and the light receiving unit. With this, it is possible to detect when the amount of deforming of the continuous sheet is larger than a predetermined amount. Further, it is possible to detect the amount of deforming in a plurality of stages by the amount of receiving light detected. An actuator or laser displacement meter can be used as the detecting unit of the deforming amount.

FIG. 12B is an example in which the operation is switched according to the type of continuous sheet used. A coated sheet or film easily receives influence of heat compared to a normal sheet and is easily deformed. Therefore, when the coated sheet or the film is used, the operation C is selected. When the normal sheet is used, the operation B is selected. Since the operation is switched according to the type of continuous sheet, the operation can be selected without the trouble of detecting the amount of deforming.

FIG. 12C is an example of selecting the operation according to a combination of the deforming amount (FIG. 12A) and the type of continuous sheet (FIG. 12B). FIG. 12C is set so that the operation is switched according to the type of continuous sheet even if the amount of deforming is the same. This is because complicated deform (sharpen) easily occurs in the film than the normal sheet). In such cases, the shape of the continuous sheet is easily corrected by pressing the fixing belt 63. In the example of selecting the operation (FIG. 12C), more suitable processing can be performed compared to when the operation is selected according to only the amount of deforming (FIG. 12A) or only the type of continuous sheet (FIG. 12B).

The operation selection is described based on FIG. 12A to FIG. 12C, but the examples can be suitably changed. The number of operations is not limited to 3 (operations A, B, and C), and can be divided into more types of operations. Alternatively, the operation may not be switched and only one operation may be selected each time. For example, when it is set to always select the operation C, the processing may take time but it is possible to reliably prevent the scratch in the fixing belt 63.

Other than the above methods of selecting operation, the operation can be selected based on the temperature or the humidity (state) in the fixing unit 60 or the apparatus main body 1B. The operation may be selected based on the amount of time from the previous job.

The embodiments of the present invention is described, but the present invention can be used not only in the fixing belt 63 but also in a rotating driving unit including a rotating member which can be pressed and separated. According to the present embodiment, the fixing unit 60 includes a fixing belt 63. However, the present invention can be applied in a structure without the fixing belt 63 (for example, rotating separated for the purpose of cleaning).

In step S107 of FIG. 9, the conveying speed of the continuous sheet is changed according to the fixing temperature, but the conveying speed can be determined by combining the type of continuous sheet to the above. In this case, preferably, the conveying speed of the coated sheet and the film is set faster than the normal sheet. With this, the conveying speed can be changed to the conveying speed suitable according to the type of continuous sheet.

When the continuous sheet is moved, the continuous sheet can be moved upstream by the upstream roller. With this, it is possible to prevent waste of the continuous sheet.

The detailed configuration and operation can be suitably modified without leaving the scope of the present invention.

The present U.S. patent application claims priority under the Paris Convention of Japanese Patent Application No. 2015-061984 filed on Mar. 25, 2015 the entirety of which is incorporated herein by reference.

What is claimed is:

1. An image forming apparatus comprising:

a conveying unit which conveys a continuous sheet at least longer than a length of the image forming apparatus itself;

an image forming unit which forms an image on the continuous sheet conveyed by the conveying unit;

a first rotating member in the conveying unit; and a second rotating member opposing the first rotating member in the conveying unit, wherein, the first rotating member can be pressed to and separated from the second rotating member;

the first rotating member can be rotated while being separated from the second rotating member;

the continuous sheet can be stopped and held when the first rotating member is separated from the second rotating member; and the image forming apparatus further comprising a control unit, wherein when the continuous sheet is stopped and held and a rotation operation of the first rotating member is started, the control unit moves at least one of the first rotating member and the continuous sheet so that the continuous sheet is not in contact with the first rotating member, and then the control unit starts rotation of the first rotating member while the first rotating member is separated from the second rotating member.

2. The image forming apparatus of claim 1, wherein, the control unit moves at least the continuous sheet so that the continuous sheet does not come into contact with the first rotating member.

3. The image forming apparatus of claim 2, wherein, the first rotating member is in a position to stop and hold the continuous sheet when the first rotating member is rotated.

4. The image forming apparatus of claim 1, wherein, the control unit moves the continuous sheet using the conveying unit.

5. The image forming apparatus of claim 1, wherein, the control unit moves the continuous sheet after pressing the first rotating member to the second rotating member.

6. The image forming apparatus of claim 1, wherein, the control unit moves the continuous sheet with a roller to a downstream side than the first rotating member.

7. The image forming apparatus of claim 1, further comprising a deforming amount detecting unit which detects an amount of deforming of the continuous sheet, wherein, the control unit switches operation to move at least one of the first rotating member and the continuous sheet based on a result of detecting by the deforming amount detecting unit.

8. The image forming apparatus of claim 1, wherein, the control unit switches operation of moving at least one of the first rotating member and the continuous sheet according to a type of the continuous sheet used.

9. The image forming apparatus of claim 1, wherein, the control unit moves the continuous sheet at least past a roller next on a downstream side from the first rotating member.

10. The image forming apparatus of claim 1, wherein, the first rotating member is a belt suspended from a plurality of rollers.

11. The image forming apparatus of claim 1, wherein, the first rotating member is provided in a fixing unit which fixes the image to the continuous sheet by heat.

12. The image forming apparatus of claim 11, wherein, the rotating of the first rotating member is an operation to heat to a temperature suitable for fixing.

13. The image forming apparatus of claim 11, wherein, the control unit controls the conveying unit to convey the continuous sheet at a speed slower than the image forming speed during heating to the temperature suitable for fixing.

14. The image forming apparatus of claim 13, wherein, when the control unit controls the conveying unit to convey the continuous sheet at a speed slower than the image forming speed, the control unit changes the conveying speed of the conveying unit according to a temperature of the fixing unit.

15. The image forming apparatus of claim 13, wherein, when the control unit controls the conveying unit to convey the continuous sheet at a speed slower than the image forming speed, the control unit changes the conveying speed of the conveying unit according to a type of continuous sheet used.

16. The image forming apparatus of claim 1, wherein, the control unit moves the continuous sheet to an upstream side with a roller to an upstream side than a rotating driving unit.

17. An image forming apparatus comprising:

a conveying unit which conveys a continuous sheet at least longer than a length of the image forming apparatus itself;

an image forming unit which forms an image on the continuous sheet conveyed by the conveying unit;

a first rotating member in the conveying unit; and a second rotating member opposing the first rotating member in the conveying unit, wherein, the first rotating member can be pressed to and separated from the second rotating member;

the first rotating member can be rotated while being separated from the second rotating member;

the continuous sheet can be stopped when the first rotating member is separated from the second rotating member; and the image forming apparatus further comprising a control unit, wherein the control unit moves at least one of the first rotating member and the continuous sheet so that the continuous sheet is not in contact with the first rotating member, and then the control unit starts rotation of the first rotating member while the first rotating member is separated from the second rotating member.

* * * * *